United States Patent [19]

Berthet et al.

[11] Patent Number: 5,040,821

[45] Date of Patent: Aug. 20, 1991

[54] SAFETY BINDING FOR A SKI

[75] Inventors: Alain Berthet, Annecy; Jean-Pierre Rigal, La Balme De Sillingy, both of France

[73] Assignee: Salomon, S.A., Annecy Cedex, France

[21] Appl. No.: 508,463

[22] Filed: Apr. 13, 1990

Related U.S. Application Data

[63] Continuation of Ser. No. 242,891, Sep. 12, 1988, abandoned.

[30] Foreign Application Priority Data

Dec. 9, 1987 [FR] France ..... 87 17153

[51] Int. Cl.[5] ..... A63C 9/08

[52] U.S. Cl. ..... 280/625; 280/628; 280/634; 280/636

[58] Field of Search ..... 280/634, 628, 625, 626

[56] References Cited

U.S. PATENT DOCUMENTS

| | | | |
|---|---|---|---|
| 3,572,738 | 3/1971 | Martin | 280/625 |
| 3,950,002 | 4/1976 | Schweizer et al. | 280/625 |
| 4,095,821 | 6/1978 | Salomon | 280/628 |
| 4,362,313 | 12/1982 | Andrieu et al. | 280/628 |
| 4,365,822 | 12/1982 | Nitschko et al. | 280/625 |
| 4,434,997 | 3/1984 | Nitschko | 280/625 |
| 4,516,792 | 5/1985 | Scheck et al. | 280/634 |
| 4,538,828 | 9/1985 | Dimier | 280/628 |

FOREIGN PATENT DOCUMENTS

| | | | |
|---|---|---|---|
| 0030175 | 6/1981 | European Pat. Off. . | |
| 2366249 | 2/1983 | Fed. Rep. of Germany | 280/625 |
| 2179183 | 11/1973 | France | 280/625 |
| 2523857 | 9/1983 | France | 280/634 |
| 2548031 | 1/1985 | France | 280/634 |

*Primary Examiner*—David M. Mitchell

*Attorney, Agent, or Firm*—Sandler, Greenblum & Bernstein

[57] ABSTRACT

A safety binding for releasably holding the toe of a skier's boot to the top of a ski having a longitudinally extending median plane includes a base adapted to be attached to the top of the ski, and a clamping device mounted on the base for movement between a clamping position in which the toe of the boot is clamped to the ski and an unclamping position in which the toe of the boot is released from the ski. An actuator is provided for moving the clamp from its clamping position towards its unclamping position in response to up-and-down pivotal movement of the toe of the boot about an axis perpendicular to the median plane, or side-to-side pivotal movement of the toe of the boot about an axis perpendicular to the top of the ski. A spring-biased force transmission element is provided; and an interconnection between the force transmission element and the clamp is constructed and arranged to effect displacement of the force transmission element against the bias of the spring in response to either side-to-side pivotal movement of the toe of the boot or up-and-down movement of the toe of the boot, or combinations thereof.

55 Claims, 4 Drawing Sheets

SAFETY BINDING FOR A SKI

This application is a continuation of application Ser. No. 242,891, filed Sept. 12, 1988 now abandoned.

BACKGROUND OF THE INVENTION

1. Field of the Invention

The present invention relates to a safety binding for a ski for releasably mounting the toe of a boot to a ski.

2. Description of Background and Relevant Information

Safety bindings for mounting the toe of a boot to a ski, known as "front abutment bindings", comprise a body mounted on a base fixed to the ski. The rear portion of the body facing the toe of the boot generally carries a retention jaw in the form of two opposed lateral retention wings. An energization mechanism positioned in the body elastically biases the jaw into an engaged position in which the wings engage the toe of the boot and connect it to the ski. The elastic bias is created by a compressed energy spring, one end of which is supported on a support surface connected to the body, and the other end of which bears against a force transmission element that is longitudinally movable in the body. The force transmission element is coupled to the jaw in a manner so as to elastically bias the jaw to its engaged position at which the wings engage the toe of the boot and retain the boot on the ski.

Front abutment bindings of the type described above are disclosed in French Patent Nos. 2,179,183 (corresponding to U.S. Pat. No. 3,950,002) and 2,523,857; and also in German Patentschrifft 2,366,249.

The front abutment binding in French Patent No. 2,179,183 comprises a retention jaw constituted by two independent wings journaled on axes laterally displaced relative to the longitudinal median plane of the ski. The front or internal ends of these wings cooperate with an axial end of a member mounted for longitudinal sliding in the binding and biased by a spring which forms a portion of the energization mechanism.

French Patent No. 2,523,857 discloses a front abutment binding comprising a support pedal in contact with the sole of the boot and which constitutes a sensor for detecting a downward bias as the toe of the boot moves towards the ski in response to an incipient forward fall of the skier. The jaw in this binding is journaled around a horizontal and transverse axis effecting an upward pivotal movement of the jaw in response to an upward vertical force resulting from an incipient rearward fall of the skier.

The front abutment binding described in German Patentschrifft 2,366,249 is also the type having independent lateral retention wings journaled around respective axes. The sole grip on the binding is upwardly movable in response to an incipient rearward fall of the skier; and upward movement effects compression of a spring of the energization mechanism of the binding. Such compression lessens the stiffness of the binding and thus diminishes the force required for lateral release of the front binding.

It is an object of the present invention to provide a new improved safety binding that is more reliable than existing bindings, is simple in design, and has better sensitivity to release under the effect of a lateral bias imposed by the skier on the binding combined with either a frontward or rearward fall of the skier.

SUMMARY OF THE INVENTION

A safety binding according to the present invention for releasably holding the toe of a skier's boot to a ski having a longitudinally extending median plane includes a base adapted to be attached to the ski. A body is mounted on the base for upward pivotal movement away from the base about a first axis perpendicular to the longitudinal median plane. The body has movable retention means on its rear portion for engaging the front of a boot and maintaining the same on the ski when the retention means is in an engaged position, and for disengaging the front of the boot to release the same from the ski when the retention means is in a released position. An energization mechanism operatively associated with the body includes a force transmission element mounted for longitudinal movement on the base, and a spring engaged with said transmission element biases the transmission element. Linkage means are provided for linking the transmission element to the retention means so that the latter is resiliently biased towards its engaged position.

A first linkage element is pivotably mounted on the base for pivotal movement about a second axis perpendicular to the longitudinal median plane of the ski. Coupling means are provided on the first linkage element for coupling the same to the force transmission element. A second linkage element is pivotably mounted on the first linkage element for pivotable movement about a third axis perpendicular to the longitudinal median plane, and located between the coupling means and the second axis. Connection means are provided on the second linkage element for connecting the same to the rear portion of the body. Finally, the second and third axes, and the coupling means are constructed and arranged so that, upon upward pivotal movement of the body in response to an incipient rearward fall of the skier, the spring of the energization mechanism is further deflected to increase the bias on the transmission element.

The coupling means that couples the first linkage element to the force transmission element, the connection means that connects the second linkage elements to the body, and the linkage means that links the force transmission element to the jaw are constructed and arranged so that the binding is capable of releasing the toe of the boot from the ski in response to side-to-side pivotal movement of the toe beyond a threshold, and in response to up-and-down movement of the toe beyond a threshold, and combinations of these movements.

BRIEF DESCRIPTION OF THE DRAWINGS

Non-limiting embodiments of the present invention are shown in the attached drawings wherein.

DESCRIPTION OF PREFERRED EMBODIMENTS

Figure 1:
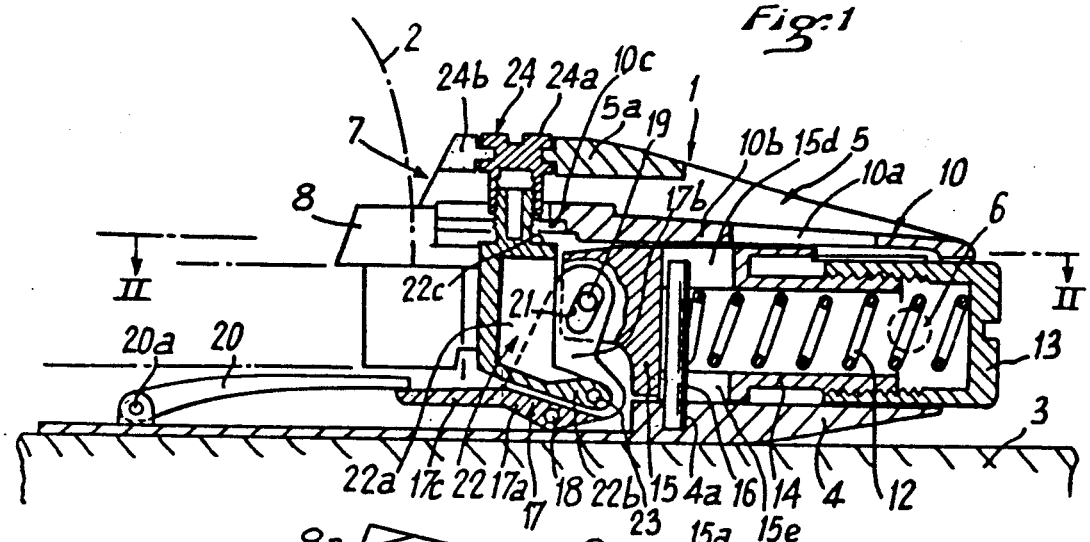
FIG. 1 is a vertical, longitudinal cross-section of a front abutment binding according to the present invention showing the parts in their engaged positions, the binding including an energy cartridge attached to the base.
Figure 2:
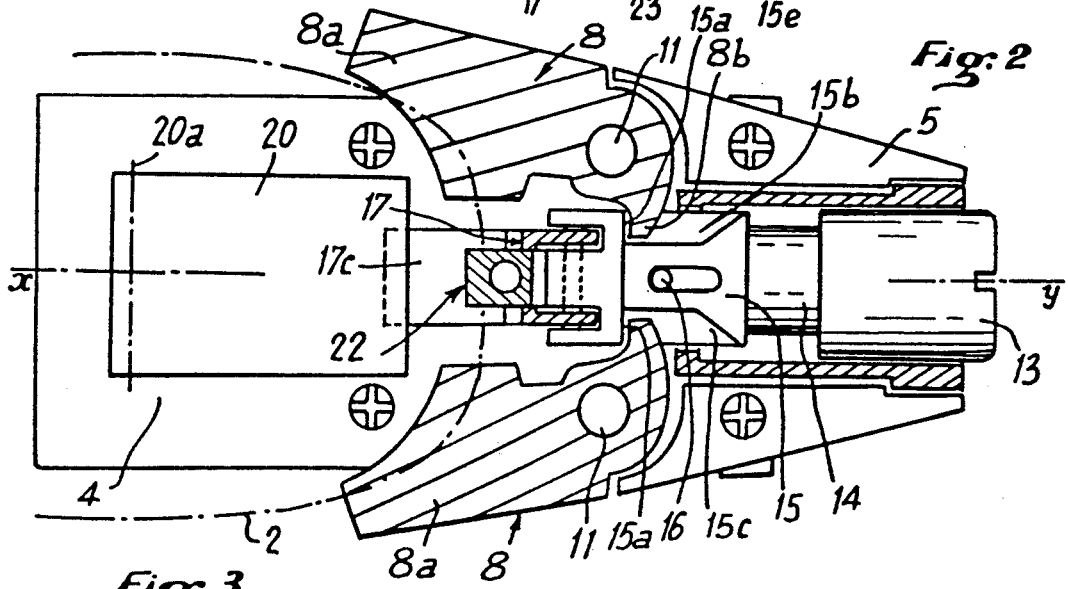
FIG. 2 is a horizontal cross-section taken along the line II—II of FIG. 1.
Figure 3:
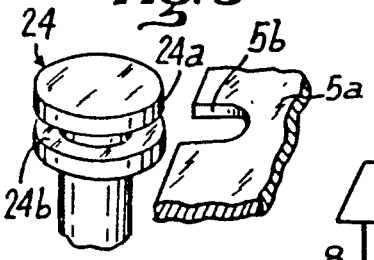
FIG. 3 is a partial perspective view of the upper portion of the front binding of the present invention showing a height adjustment screw separated from its receiving notch.

Referring now to FIGS. 1 and 2, reference numeral 1 designates a front safety binding according to the present invention adapted to clamp the front or toe of ski boot 2 (shown in chain lines) to ski 3. Binding 1 comprises base 4 affixed to the ski and on which is mounted body 5 which can pivot with respect to base 4 around horizontal and transverse axle 6 positioned at the front of body 5. Axle 6 is perpendicular to the longitudinal median plane of the ski defined by axis xy as shown in FIG. 2.

Jaw 7, on the rear portion of body 5, is adapted to engage the upper edge of the sole of boot 2. This jaw is constituted by two lateral wings 8 which can be positioned to overlie the upper edge of the sole (FIG. 1) to assure retention of the boot against vertical displacement relative to the ski.

Each of lateral wings 8 is journaled on body 5 around vertical pin 11 and comprises rear branch 8*a* extending rearwardly of pin 11 to engage the upper edge of the sole when the wings are in operative position. Each of wings 8 further includes a short front branch having catch 8*b* extending substantially transversely to longitudinal axis xy of the front binding which defines a longitudinally extending median plane of the ski.

An energization mechanism for the binding is mounted in a longitudinal bore contained in housing 10 which is attached to base 4. The mechanism comprises longitudinally extending spring 12 supported at its front end on the transverse end of front cap 13 screwed into a threaded front portion of tubular extension 14 of piston 5 which is longitudinally slideable in the bore in housing 10.

Piston 15 includes lateral surfaces 15*a* which are transverse to axis xy and are respectively engagable by catches 8*b* of the retention wings 8 when the latter are in operative position. Clearance to permit catches 8*b* to engage surfaces 15*a* are provided by beveling the upper longitudinal edges of piston 15 to define relief portions in the form of longitudinally inclined surfaces 15*b* and 15*c* which slideably engage catches 8*b* when the piston moves longitudinally. Piston 15, threaded tubular extension 14 and cap 13, constitute a force transmission element. Internal energy spring 12, which is more or less compressed between pin 16 mounted in base 4 and cap 13 of the force transmission element, rearwardly biases the force transmission element.

The degree to which energy spring 12 is compressed, which is determined by the distance cap 13 is screwed into threaded tubular extension 14, determines the "stiffness" of the binding. The degree of stiffness is indicated by the relative axial position of cap 13 which can be observed through window 10*a* provided in upper wall 10*b* of housing 10 above the connection zone between cap 13 and extension 14. Energy spring 12 is supported at its rear on vertical pin 16 centered on axis xy and positioned at its lower end in hole 4*a* formed in the upper surface of base 4. Pin 16 extends vertically through longitudinal slots 15*d* and 15*e* in the upper and lower portions of piston 15.

The rear portion of piston 15 is coupled to a first linkage element constituted by bell crank or rocker 17 having lower branch 17*a* journaled on base 4 for pivotal movement around horizontal and transverse axle 18 whose axis is perpendicular to the longitudinal median plane of the ski. Rocker 17 also includes bifurcated upper branches 17*b* extending from branch 17*a* and inclined from bottom to top and from rear to front. The coupling means by which piston 15 is connected to rocker 17 in the embodiment shown in FIGS. 1–4 is a so-called double-effect type in the sense that displacement of piston 15, either forwardly or rearwardly, imparts pivotal movement to rocker 17. The coupling means comprises horizontal and transverse pin 19 carried by body 5 and vertically positioned, with respect to the top of the ski, above transverse axles 6 and 18. The free ends of pin 19 project through elongated inclined slots 21 in each of the upper portions of the branches 17*b* of rocker 17. Slots 21 are inclined from bottom to top, and from front to rear as seen in FIG. 1.

Rocker 17 further comprises rear activation extension 17*c* extending rearwardly from branch 17*a*. Extension 17*c* is horizontal, or slightly inclined from bottom to top and from front to rear in the rest or engaged position of the binding. On the free end of actuation extension 17*c* rests the free front end of pedal 20 journaled at its rear end for pivotal movement about horizontal and transverse axle 20*a* whose axis is perpendicular to the transverse median plane of the ski. When the boot is mounted on the binding, the sole of the boot engages pedal 20 which thus forms a frontward fall sensor.

Front binding 1 also includes a second rigid linkage element 22 which establishes a linkage between the first linkage element, constituted by rocker 17, and the upper rear portion 5*a* of body 5. Second rigid linkage element 22 is constituted by a second rocker or bell crank having vertical body 22*a* having branches 22*b* which extend from the lower end of body 22*a*, and which are inclined from top to bottom and from rear to front. Branches 22*b* are journaled respectively on bifurcated branches 17*b* of rocker 17 for pivotal movement around horizontal and transverse axle 23 whose axis is perpendicular to the longitudinal median plane of the ski. Relative to the top of the ski, axle 23 lies vertically below pin 19, and forwardly of axle 18. Axle 23 is located longitudinally on the binding between axles 6 and 18. That is to say, axle 23 is located between vertical planes that are perpendicular to the longitudinal median plane of the ski and respectively pass through axels 6 and 18.

The upper end of body 22*a* of second rocker 22 is threaded into vertical height adjustment screw 24 which comprises upper head 24*a* beneath which is annular grove 24*b* engaged in receiving notch 5*b* (FIG. 3) in an edge of upper and rear horizontal portion 5*a* of body 5. Notch 5*b* is located above rockers 17 and 22, and is defined by a U-shaped aperture that opens towards the rear.

When a purely lateral bias is applied to the binding, which results when the leg of a skier is twisted and the toe of the boot pivots on the ski about an axis perpendicular to the top surface of the ski, the rear branch of one of lateral retention wings 8 moves outwardly as the wing pivots around axle 11. Simultaneously, front catch 8*b* of the pivoting wing contacts transverse surface 15*a* of piston 15 and displaces the same rearwardly effecting rearward translation of the energy cartridge assembly. This displacement further compresses energy spring 12 until the boot reaches a predetermined angular displacement relative to the xy axis of the binding, termed the lateral release threshold, at which the sole of the boot near the toe thereof clears the rear branch of the wing that pivots, and the boot is freed from the binding.

Figure 4:
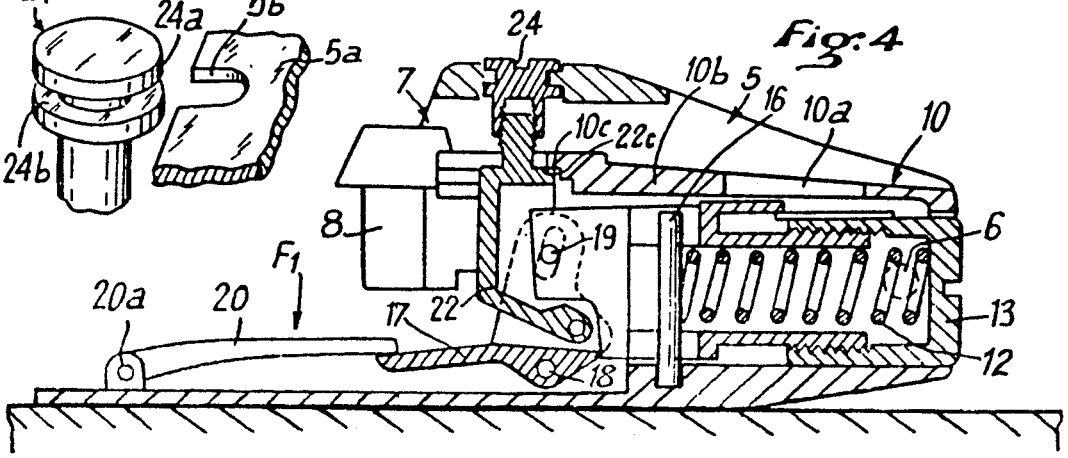
FIG. 4 is a vertical, longitudinal cross-section of the front abutment binding of FIG. 1, but showing the body of the binding pivoted upwardly under the effect of a vertical force due to an incipient rearward fall of a skier.
Figure 5:
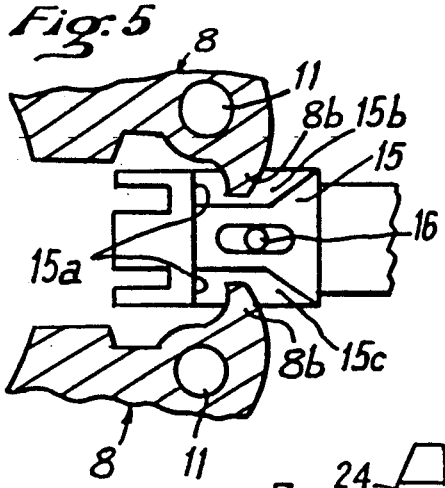
FIG. 5 is a horizontal partial cross-section of the piston of the energy cartridge and of the retention wings, the piston of the energy cartridge being shown displaced towards the rear resulting from a rearward fall of the skier.

In the case of an incipient purely rearward fall of the skier, wherein the boot pivots upwardly in the median plane of the ski about an axis perpendicular to the median plane, the toe of boot 2 raises jaw 7 which pivots body 5 in the clockwise direction around axle 6 as shown in FIG. 1. This movement of body 5 imparts an upward displacement to rocker 22 which is connected to body 5 through screw 24, and more particularly through groove 24*b* thereof engaged in notch 5*b*. This upward displacement of rocker 22 causes rocker 17 to pivot in the counter-clockwise direction as shown in FIG. 1 around axle 18 because of the upward movement of axle 23 by which rockers 17 and 22 are connected. The pivoting movement of rocker 17 imparts rearward displacement to piston 15 because of the coupling means between rocker 17 and the force transmission element established at pin 19 on piston 15 and slots 21 in rocker 17. Consequently, force transmission element 15, 14, 13 is moved rearwardly as shown in FIGS. 4 and 5. Energy spring 12 thus is further compressed until the jaw reaches a threshold at which the jaw is sufficiently open to free the boot from the binding.

In a case of a rearward fall of the skier combined with twisting of his leg, jaw 7 is upwardly biased at the same time that one of the wings is laterally displaced. As indicated above, the lifting of jaw 7 by the front of boot 2 effects retraction of piston 15 (FIG. 5) against spring 12, and front transverse surface 15*a* of piston 15 is displaced slightly from catches 8*b* of lateral retention wings 8. As a result, limited lateral displacement of the boot can be effected free from any bias imposed by spring 12 on such displacement. As a consequence, less lateral bias must be applied by the boot to effect its release from the front binding under these conditions than is required in the case of a purely lateral bias applied to the binding. In effect, a portion of the work absorbed by the additional compression of energy spring 12 is furnished by the lifting movement of front portion of the boot in response to a rearward fall. Consequently, the "stiffness" of the binding is lessened under these conditions.

In the case of a frontward fall, the boot of the skier exerts a downward vertical force Fl (FIG. 6) on pedal 20 directed towards the ski. The clockwise pivoting of pedal 20 as seen in FIG. 4 causes a counter-clockwise pivoting of rocker 17 around journal axis 18. The coupling means established by pin 19 and slots 21 in rocker 17 effects rearward displacement of piston 15 thereby compressing spring 12. This rearward movement of piston 15 is accompanied by the lifting of rocker 22 which results in an upward pivoting (i.e., clockwise as seen in the drawings) of body 5. As a result, jaw 7 opens and reduces its frictional engagement with the sole of boot 3. This movement likewise reduces the stiffness of the binding and has the advantage, if a torsional bias is associated with the forward fall, of reducing the lateral release threshold of the binding.

Figure 6:
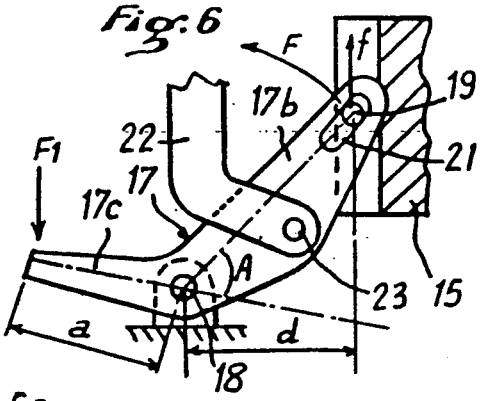
FIG. 6 is a schematic elevation view, partially in section, illustrating the operation of a first linkage element of the front abutment binding of FIGS. 1–3 during an incipient frontward fall of the skier.

FIG. 6 illustrates, in a detailed manner, the role played by rocker 17 in the case of a forward fall. Rear 17*c* of rocker 17 is subjected to force F1 directed towards the top of the ski; and this translates into a force f acting on pin 19 near the upper end of branches 17*b* of rocker 17. Inclined slots 21 on arm 17 act against pin 19 imparting a rearward displacement to piston 15. The magnitude of force f reduces the stiffness of the binding, depending on the moment arms a and d of leg 17*c*, and the angle A between the leg and arm 17*b*. Judicious selection of the values of moment arms and the angle permit the stiffness of the binding to be designed to accommodate different levels of skill of a skier.

As can be seen in FIGS. 1–4, leg 22*a* of rocker 22 preferably has an upper shoulder 22*c* which contacts rear fixed portion 10*c* of upper wall 10*b* of housing 10 in a manner so as to limit upward pivotable movement of body 5 about axle 6.

Figure 7:
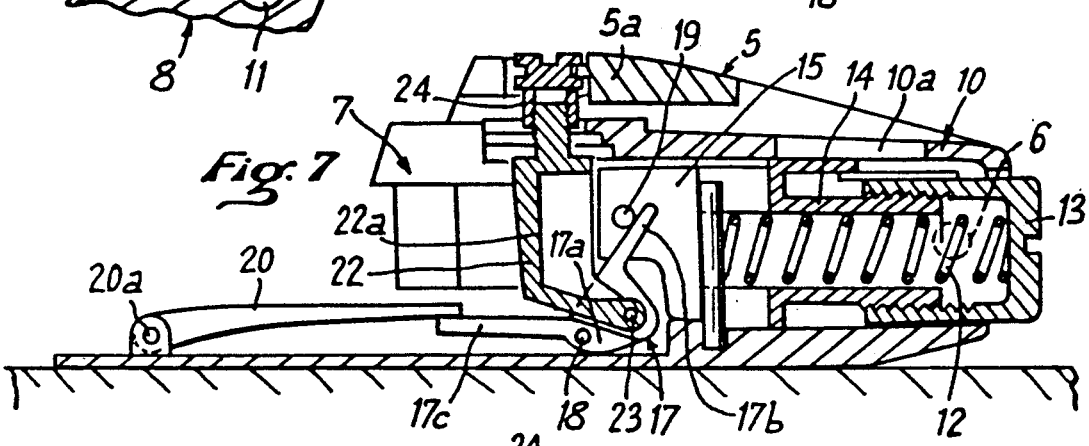
FIGS. 7 and 8 are longitudinal, vertical cross-sectional views showing the rest and the lateral biased positions respectively, of an embodiment of a front abutment binding according to the present invention in which linkage apparatus, interconnecting the first linkage element with the piston, is of the single-effect type.
Figure 8:
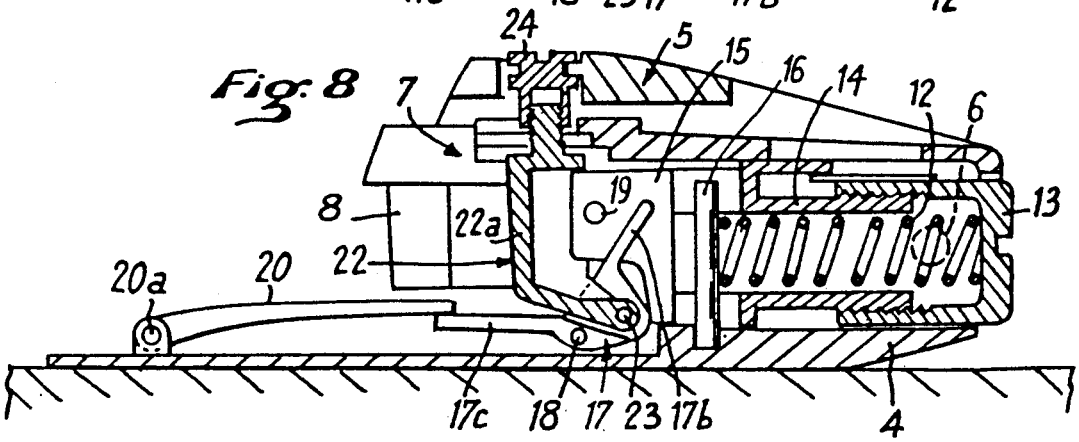

In the embodiment shown in FIGS. 7 and 8, the coupling means between piston 15 and rocker 17 is of the single-effect type, which is to say that rearward movement of the piston may occur independently of any pivotal movement of rocker 17. Thus, this embodiment differs from the embodiment previously described which utilizes a double-effect type of coupling means. In the embodiment of FIGS. 7 and 8, each branch 17*b*′ of rocker 17 is in the form of an arm which extends upwardly and is inclined from bottom to top and from rear to front. The upper free end portion of this arm simply rests against horizontal and transverse pin 19 fixed to piston 15 at a point beneath, and forwardly, of this pin. As a result, in the case of a purely lateral bias on the binding, i.e., a side-to-side pivotal movement of the toe of the boot about an axis perpendicular to the top of the ski such as is produced by a twisting of the skier's leg unaccompanied by a rearward fall of the skier, the pivotal movement of one of the retention wings 8 causes catch 8*b* to engage and rearwardly displace piston 5 against the bias of spring 12 as in the preceding embodiment. In this particular embodiment, however, such rearward displacement of the piston is unaccompanied by simultaneous pivotal movement of rocker 17 which remains stationary. As a result, both rocker 22 and body 5 are unaffected by the retraction of the piston.

On the other hand, when rocker 17 is involved in the release process, e.g., in response to pivotal movement of the toe of the boot about an axis perpendicular to the median plane of the ski occasioned by an incipient forward or rearward fall of the skier, rocker 17 pivots counterclockwise as seen in FIG. 7 about axel 18 causing the arms on branch 17*b;* to push against pin 19 thereby rearwardly displacing piston 15. In this case, body 5 pivots about axel 6, but the "stiffness" of the binding is reduced as compared to the "stiffness" of the binding in response to combined side-to-side pivotal movement of the toe of the boot and upper displacement of the body due to twisting of the leg of the skier during a forward fall.

In all of the embodiments of the invention described above, screw 24 makes it possible to adjust the height of jaw 7 to accommodate various thicknesses of sole 2 of the boot. The vertical position of groove 24*b* in screw 24, and consequently the angular position of body 5 in relation to base 4, is dependent on the degree to which screw 24 is threaded into body 22*a* of rocker 22. This adjustment in no way affects the bias exerted by spring 12 of the energization mechanism.

Figure 9:
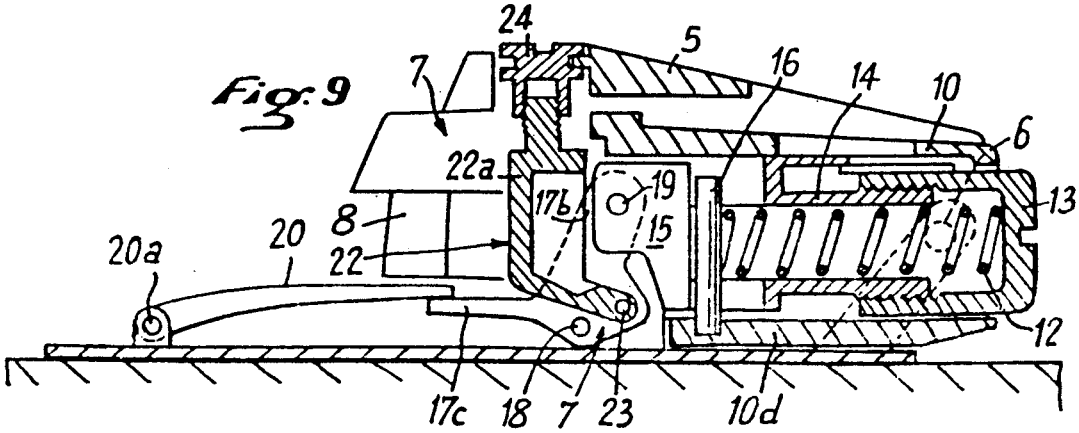
FIGS. 9 and 10 are respectively longitudinal and vertical cross-sections showing the rest position and the lateral biased position, respectively, of an embodiment of a front abutment binding according to the present invention in which the energy cartridge is pivotally mounted with the body.
Figure 10:
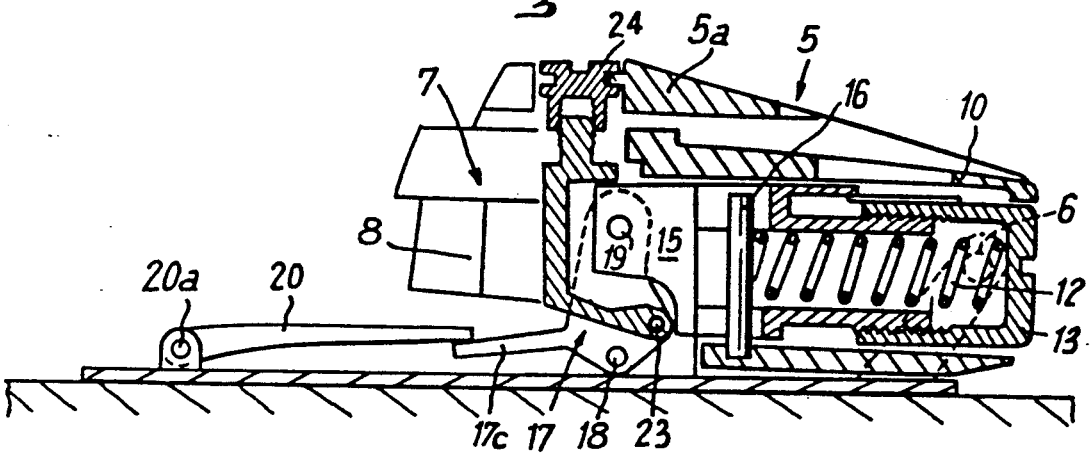

In the embodiment of the invention shown in FIGS. 1–8, the energization mechanism is in the form of energy cartridge 12–15 which remains connected to base 4 while being contained in housing 10. Only body 5 pivots in this embodiment. However, an energy cartridge that pivots together with body 5 can be provided. Such an alternative embodiment is shown in FIGS. 9 and 10. In this embodiment, housing 10' enclosing the energy cartridge, which is constituted by spring 12, cap 13, tubular extension 14 and piston 15, is part of pivotal body 5' which also supports pin 16 whose lower end is fixed in lower wall 10*d'* and which projects into a longitudinal opening in the housing. In this alternative embodiment, body 5' pivots about pin 6 which is carried by a pair of extension arms projecting forwardly and upwardly adjacent the front end of the base.

Figure 11:
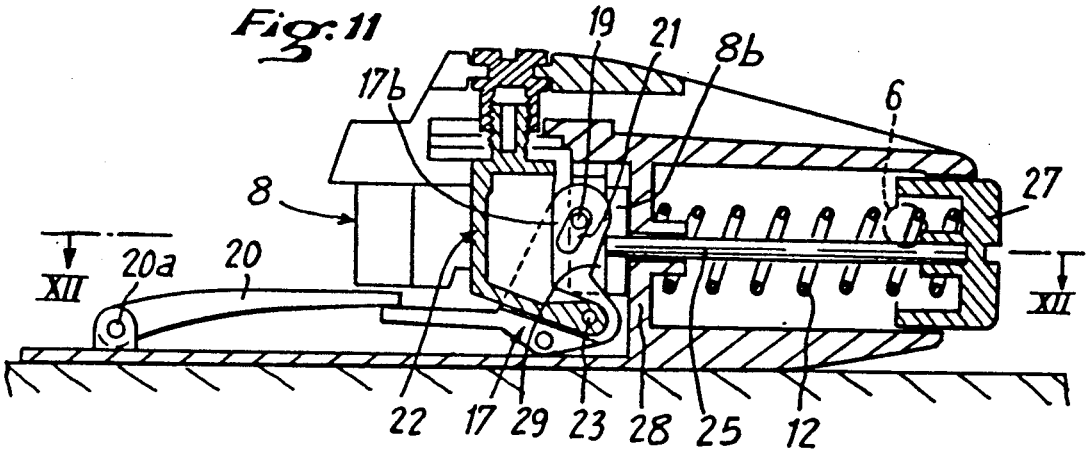
FIG. 11 is a vertical, longitudinal cross-section of an embodiment of the front abutment binding according to the present invention in which the energization mechanism comprises a forwardly biased longitudinal member.
Figure 12:
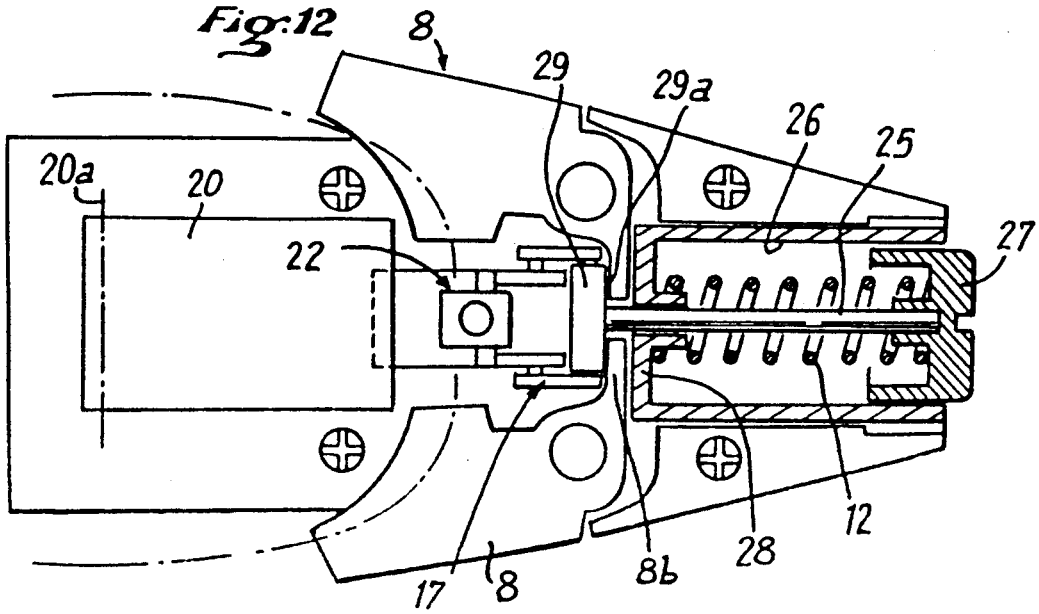
FIG. 12 is a horizontal cross-section taken along line XII—XII of FIG. 11.

In the embodiment of the invention shown in FIGS. 11 and 12, the housing containing the force transmission element of the energization mechanism is rigidly attached to the base as with the embodiment of FIGS. 1–4; but the force transmission element includes longitudinally extending stay rod 25 coaxially supported in longitudinal bore 26 in housing 10" by a central hub in transverse wall 28. The front end of compression spring 12, which surrounds rod 25, is supported on cap 27 slideably mounted in bore 26, and which is threaded to the front of rod 25. The degree of compression of spring 12, and consequently the "stiffness" of the binding, is adjustable by screwing cap 27 inwardly or outwardly on rod 25. The rear end of compression spring 12 is supported in a bore contained in the central hub on wall 28 which slideably supports rod 25 for forward and rearward longitudinal movement. The rear end of rod 25 is fixed to head 29 which has a width sufficient for front surface 29*a* of the head to engage catches 8*b* of lateral retention wings 8 (FIG. 12). These catches are received in the space between front surface 29*a* of head 29 and transverse wall 28.

As shown in FIG. 12, catch 8*b* of wing 8 is engaged with the front surface of head 29 which is coupled to the upper portion of the first linkage element constituted by rocker 17 by means of pin 19 engaged in slots 21 of branches 27*b* of the rocker. Alternatively, this double-effect coupling means can be modified so as to utilize a single-effect coupling means as previously described with respect to FIGS. 7 and 8.

Figure 13:
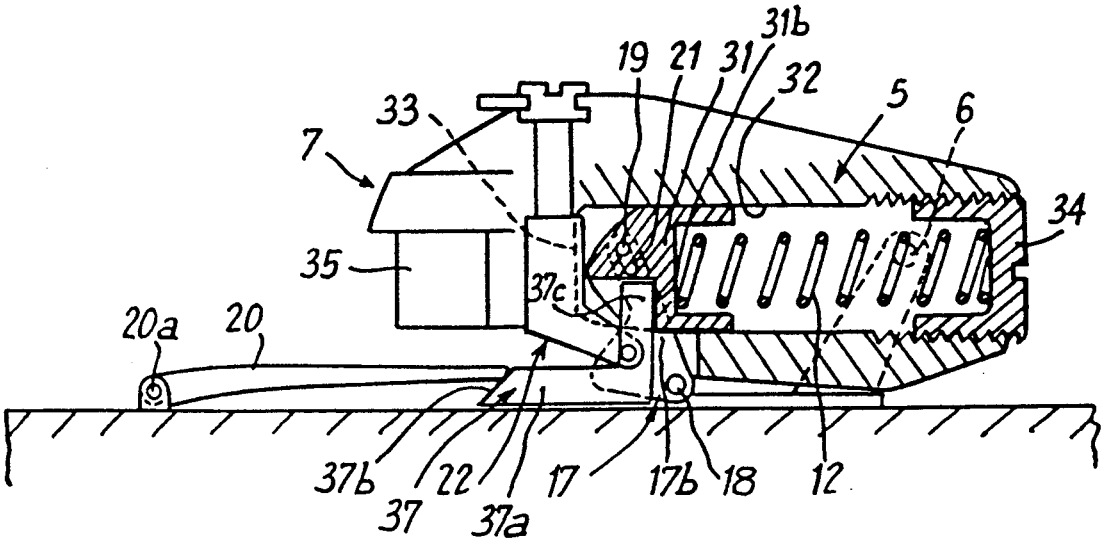
FIG. 13 is a vertical, longitudinal cross-section of an embodiment of the front abutment binding according to the present invention in which the energization mechanism comprises a rearwardly biased piston.
Figure 14:
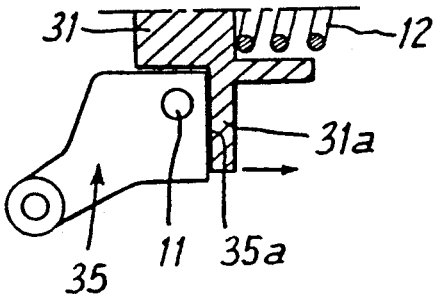
FIG. 14 is a horizontal, partial cross-section of the front binding of FIG. 13.

In the embodiment of the invention shown in FIGS. 13 and 14, body 5" is pivotably mounted on the base in a manner similar to that shown in FIG. 9, and contains force transmission element 31 constituted by a piston slideably positioned in longitudinal bore 32 of body 5". Element 31 is biased towards front 33 of bore 32 by compression spring 12 which is supported, at its front end, on stiffness adjustment cap 34 threaded into a tapped hole provided at the front end of bore 32. Horizontal and transverse pin 19 in element 31 is engaged in inclined slots 21 in the upper end portions of branches 17*b* of rocker 17. In this embodiment, the slots are inclined from bottom to top and from front to rear. Consequently, in this embodiment of the invention, the lower journal axle 18 of rocker arm 17 (i.e., the third axis in the system) is longitudinally located between vertical planes that are perpendicular to the median plane and that contain, respectively, journal axles 19 of branches 17*b* and journal axle 36 of rocker 5". In this case, each lateral retention wing 35 of jaw 7 is journaled on body 5" for pivotal movement about vertical axis 11 in a manner so as to displace piston 31 forwardly (i.e., to the right as seen in FIGS. 13 and 14) when a lateral bias is applied to wing 35. To this end, each wing has a transverse front surface 35*a* in contact with transverse projection 31*a* of piston 31. In this manner, projection 31*a* and consequently piston 31, are displaced forwardly when wing 35 is itself pivoted outwardly relative to the ski in response to side-to-side movement of the toe of the boot.

The front abutment shown in FIGS. 13 and 14 likewise comprises pusher 37 mounted under the rear portion of body 5" for slideable longitudinal movement on the base. Pusher 37 comprises horizontal arm 37*a* extending towards the rear and terminating in rear surface 37*b* forming a cam inclined from bottom to top and from front to rear. Surface 37*b* supports the front end of pedal 20 which forms a forward fall censor. Pusher 37 comprises, on its front portion, vertical branch 37*c* which extends upwardly and which engages in a clearance opening in the lower portion of piston 31. The upper portion of the front surface of branch 37*c* engages rear vertical surface 31*b* of piston 31.

In the case of a forward fall, the free end of pedal censor 20 is displaced by the sole of the boot toward the top of the ski and slides on inclined cam 37*b* which forwardly displaces pusher 37 on the base. Vertical branch 37*c* of pusher 37 engaged with piston 31 imparts forward movement to the pusher which results in additional compression of energy spring 12 thus reducing the "stiffness" of the binding in response to a lateral bias produced by side-to-side movement of the toe of the boot. The forward displacement of piston 31 likewise imparts upward vertical displacement to journal axle 19 as body 5" pivots in the clockwise direction as seen in FIG. 13. This upward movement of body 5" slightly opens jaw 7 and consequently reduces the friction exerted by the jaw on the top edge of the sole of the boot as the latter moves relative to the binding.

Although, in all the embodiments of the invention previously described, the binding has been assumed to include independent lateral retention wings journalled around respective axes, it is evident that the double rocker mechanism likewise can be applied to a front binding utilizing a monoblock jaw, i.e., a jaw in which two lateral retention wings form a single element with a central linkage portion constituting a sole grip.

Finally, although the invention has been described with reference to particular means, materials and embodiments, it is to be understood that the invention is not limited to the particulars disclosed and extends to all equivalents within the scope of the appended claims.

What is claimed is:

1. A safety binding for a ski for releasably maintaining the toe of a boot mounted on the ski having a longitudinal median plane, said binding comprising:

a) a body mounted on a base fixed to the ski, said body including a retention jaw having a sole grip on the rear portion thereof and being movable between an engaged position at which the sole grip engages the boot and holds the same to the ski, and a released position at which said sole grip releases said boot, and an energization mechanism for elastically biasing the jaw toward its engaged position;

b) said energization mechanism including a force transmission element longitudinally movable in the binding, an energy spring operatively engaged with the element for biasing the same, and linkage means for linking the transmission element to the jaw so as to elastically bias the jaw to its engaged position thereby releasably retaining the boot on the ski;

c) said body being pivotally mounted on the forward portion of the base around a first axis that is perpendicular to said median plane;

d) said linkage means including a first linkage element having upper and lower ends and being pivotably mounted to said base on a second horizontal and transverse axis perpendicular to said median plane, coupling means for coupling the upper end of said first element to the force transmission element, and a second linkage element having upper and lower ends and being coupled at its upper end to the rear portion of said body, and journalled, at its lower end, on said first linkage element for pivotal movement about a third axis perpendicular to said longitudinal median plane;

e) the second and third axes, and said coupling means being positioned, with respect to each other, in a manner such that upward pivotal movement of said body around said first axis in response to a rearward fall of the skier, effects displacement of said force transmission element in a direction against the bias of said energy spring.

2. A safety binding for a ski according to claim 1 wherein said movable retention jaw includes two laterally disposed retention wings respectively journaled on said body for pivotal movement about axes that are parallel to said longitudinal median plane and perpendicular to said first axis, each lateral retention wing having front and rear branches projecting at an obtuse angle from the pivot axis of the wing, the free end of each front branch forming a catch that is engageable with a surface of the rear portion of the force transmission element, the rear branch of each wing being inclined from the interior towards the exterior and from front to rear.

3. A safety binding for a ski according to claim 2 wherein:

a) said spring is a compression spring that forwardly biases the force transmission element, said spring being mounted in a longitudinally extending opening in the force transmission element and having one end bearing against a support fixed to the base, and the other end bearing against a cap fixed to the front end of the force transmission element;

b) said first linkage element normally being downwardly inclined from top to bottom and from front to rear when said jaw is in its engaged position;

c) said first linkage element being constructed and arranged so that said third axis is longitudinally positioned between intermediate vertical planes that are perpendicular to the longitudinal median plane of the ski and pass, respectively, through the first and second axes.

4. A safety binding for a ski according to claim 1 wherein:

a) said spring is a compression spring that forwardly biases the force transmission element, said spring being mounted in a longitudinally extending opening in the force transmission element and having one end bearing against a support fixed to the base, and the other end bearing against a cap fixed to the front end of the force transmission element;

b) said first linkage element normally being downwardly inclined from top to bottom and from front to rear when said jaw is in its engaged position;

c) said first linkage element being constructed and arranged so that said third axis is longitudinally positioned between intermediate vertical planes that are perpendicular to the longitudinal median plane of the ski and pass respectively through the first and second axes.

5. A safety binding for a ski according to claim 2 wherein said first linkage element is constituted by a bell crank having a lower branch that extends rearwardly from said second axis, and front branches means inclined from top to bottom and from front to rear, said front branch means connected to the rear portion of the force transmission element by said coupling means.

6. A safety binding according to claim 3 wherein said first linkage element is constituted by a bell crank having a lower branch that extends rearwardly from said second axis, and front arm branch means inclined downwardly from top to bottom and from front and rear, said front branches being connected to the rear portion of the force transmission element by said coupling means.

7. A safety binding according to claim 4 wherein said first linkage element is constituted by a bell crank having a lower branch that extends rearwardly from said second axis, and front arm branch means inclined downwardly from top to bottom and from front to rear, said front branches being connected to the rear portion of the force transmission element by said coupling means.

8. A safety binding for a ski according to claim 5 wherein said coupling means, by which the upper portion of said branch means of said first linkage element are connected to the rear portion of said force transmission element, is a double-effect linkage apparatus.

9. A safety binding for a ski according to claim 8 wherein said coupling means includes a pin mounted on said force transmission element, and an elongated slot in the upper portion of said branch means of said first linkage element, each slot being inclined from bottom to top and from front to rear and operatively receiving said pin.

10. A safety binding for a ski according to claim 5 wherein said coupling means, by which the upper portions of said front branch means of said first linkage element are connected to the rear portion of said force transmission element, is a single-effect linkage apparatus by which forward movement of the force transmission element imparts no movement to said first linkage element.

11. A safety binding for a ski according to claim 10 wherein said coupling means includes a pin mounted on said force transmission element and an upward extending arm on said branch means which is downwardly inclined from top to bottom and from front to rear, said pin being engaged with said branch means beneath and forwardly of the axis of the pin.

12. A safety binding for a ski according to claim 1 wherein the force transmission element is constituted by a front cap connected to a rear piston for forming an assembly mounted for longitudinal movement in an opening in a housing, said force transmission element and said energy spring forming an energy cartridge.

13. A safety binding for a ski according to claim 12 wherein said piston is provided with a tubular extension into which said cap is screwed, said housing having a window in an upper wall thereof for viewing said cap in a manner so as to indicate the adjustment of the "stiffness" of the binding.

14. A safety binding for a ski according to claim 12 wherein said housing is part of said base, and said energy spring is supported, at its front end, on said cap and, at its rear end, on a vertical support element fixed at its lower end to said base.

15. A safety binding for a ski according to claim 13 wherein said housing is part of said base, and said energy spring is supported, at its front end, on said cap and, at its rear end, on a vertical support element fixed at its lower end to said base.

16. A safety binding for a ski according to claim 12 wherein said housing is part of said body and said energy spring is supported, at its front end, on said cap and, at its rear end, on a support element whose lower end is mounted in a lower wall of said opening.

17. A safety binding for a ski according to claim 13 wherein said housing is part of said body and said energy spring is supported, at its front end, on said cap and, at its rear end, on a support element whose lower end is mounted in a lower wall of said opening.

18. A safety binding for a ski according to claim 2 wherein the force transmission element is constituted by a front cap connected to a rear piston for forming an assembly mounted for longitudinal movement in an opening in a housing, said force transmission element and said energy spring forming an energy cartridge.

19. A safety binding for a ski according to claim 18 wherein said piston has transverse lateral surfaces for engaging the catches of the front branches of the two retention wings, and relief portions on longitudinally extending lateral surface of said piston for providing clearance for said catches.

20. A safety binding for a ski according to claim 19 wherein said piston is provided with a tubular extension into which said cap is screwed, said housing having a window in an upper wall thereof for viewing said cap in a manner so as to indicate the adjustment of the "stiffness" of the binding.

21. A safety binding for a ski according to claim 20 wherein said housing is part of said body and said energy spring is supported, at its front end, on said cap and, at its rear end, on a support element whose lower end is mounted in a lower wall of said opening.

22. A safety binding for a ski according to claim 20 wherein said housing is part of said base, and said energy spring is supported, at its front end, on said cap and, at its rear end, on a vertical support element fixed at its lower end to said base.

23. A safety binding for a ski according to claim 3 wherein the force transmission element of the energization mechanism is constituted by a longitudinal stay rod located in a longitudinal bore in a housing, said stay rod being biased by said spring whose front end is supported on a cap which is fixed to the front end of said stay rod and which can slide in said bore, said cap being axially adjustable on the stay rod for adjusting the level of compression of said spring and consequently the "stiffness" of the binding, said stay rod extending rearwardly through a transverse wall of said housing which defines the rear end of said bore against which one end of the compression spring bears, the rear end of the stay rod being attached to a head having a front surface which is engagable with the catches of said lateral retention wings, and linkage means for linking said head to the upper portion of said first linkage element.

24. A safety binding for a ski according to claim 1 wherein the first linkage element includes a substantially horizontal, rearwardly extending activation arm, and a pedal which forms a frontward fall sensor and which is journalled for pivotal movement about a fourth horizontal and transverse axis, the free end of said pedal engaging the free end of said activation arm.

25. A safety binding for a ski according to claim 1 in which said spring is a compression spring, and said force transmission element is constituted by a piston slideably mounted in a longitudinal bore in said body, said piston being rearwardly biased by said spring, the front end of which bears against a stiffness adjustment cap threaded into the front end of said bore, and the rear end of which bears against said piston, and coupling means coupling the upper end portion of the first linkage element to said piston, said coupling means being constructed and arranged such that the third axis is longitudinally located between the first and second axes.

26. A safety binding for a ski according to claim 2 wherein said spring is a compression spring, and said force transmission element is constituted by a piston slideably mounted in a longitudinal bore in said body, said piston being rearwardly biased by said spring, the front end of which bears against a stiffness adjustment cap threaded into the front end of said bore, and the rear end of which bears against said piston, and coupling means coupling the upper end portion of the first linkage element to said piston, said coupling means being constructed and arranged such that the third axis is longitudinally located between the first and second axes.

27. A safety binding for a ski according to claim 26 wherein each lateral retention wing of said jaw is journalled on said body for pivotal movement around a vertical axis parallel to said median plane and is positioned in a manner so as to forwardly displace said piston in response to side-to-side pivotal movement of the toe of said boot, each wing having a transverse front surface in contact with a transverse projection of said piston in a manner so as to forwardly displace said piston when a wing is pivoted laterally towards the exterior of the ski.

28. A safety binding for a ski according to claim 27 including a pusher longitudinally slideably mounted under the rear portion of said body, said pusher including a rearwardly extending horizontal branch terminating in a rear surface forming a cam inclined from bottom to top and from front to rear, a pedal forming a frontward fall sensor and journalled around a horizontal and transverse axis, the free end of said pedal engaging said cam on said pusher which includes an upwardly extending vertical branch located in an opening in the lower portion of said piston and bearing against a rear vertical surface thereof so as to forwardly displace said piston in response to a frontward fall wherein said pedal is depressed by the toe of the boot.

29. A safety binding for a ski according to claim 1 wherein the second linkage element is constituted by a rocker which comprises a vertical body having branch means on its lower end, said branches being inclined from top to bottom and from rear to front, and on which is journalled said first linkage element defining said third axis.

30. A safety binding for a ski according to claim 29 wherein said vertical body carries a vertical height adjustment screw on its upper end, said screw being threaded to the uppermost portion of said second linkage element and which is coupled to the upper and rear portion of said body.

31. A safety binding for a ski according to claim 30 wherein said height adjustment screw comprises an upper head beneath which is provided a transverse annular groove engaged in a receiving cut-out notch provided in an edge of an upper and posterior horizontal portion of said body, said cut-out being U-shaped and opening towards the rear.

32. A safety binding for a ski according to claim 29 wherein said vertical body of said second linkage element has an upper shoulder engageable by a rear fixed portion on said body when the latter pivots for limiting upward pivotal movement of said body.

33. A safety binding for releasably holding the toe of a skier's boot to the top of a ski having a longitudinally extending median plane, said binding comprising:

a) a base adapted to be attached to the top of the ski;

b) a body movably mounted on said base and having clamping means which overlie and clamp the toe of the boot to the ski when the body is in a clamped position and which are displaced from the toe of the boot when the body is in an unclamped position at which the toe of the boot is released from the ski;

c) a pedal adapted to be movably mounted on the ski beneath the toe of the boot when the latter is clamped to the top the ski, and a bell crank pivotally mounted on the base including a pair of rigidly connected arms, one of which engages the pedal for pivoting the crank in one direction in response to downward pressure of the toe of the boot due to an incipient forward fall of the skier, and the other of which is a first linkage element;

d) a second linkage element having an articulated connection to said first linkage element and having a connection to said body for moving the latter toward its unclamped position in response to said movement of said bell crank in said one direction;

e) spring bias means; and f) coupling means for coupling said spring bias means to said first linkage element for urging said bell crank in a direction opposite to said one direction.

34. A safety binding according to claim 33 wherein said spring bias means includes a force transmission element and a spring for biasing the same, said coupling means being constructed and arranged to displace said force transmission element against the bias of said spring in response to movement of said bell crank in said one direction.

35. A safety binding according to claim 33 wherein the clamping means is spaced from the toe pedal, and one of the linkage elements is adjustable to selectively adjust said spacing.

36. A safety binding according to claim 33 wherein said toe is captured between said clamping means and said pedal when said clamping means is in its clamped position, and said second linkage element includes means for adjusting the distance between said clamping means and said pedal to accommodate the toes of boots of different sizes.

37. A safety binding according to claim 34 including a pair of wings movably mounted on said body for movement in response to side-to-side movement of the toe of the boot, and means on said wings cooperable with said force transmission element for moving the latter against the bias of said spring in response to side-to-side movement of the toe of the boot.

38. A safety binding according to claim 37 wherein said coupling means is constructed and arranged to move the bell crank in said one direction in response to side-to-side movement of the toe of the boot.

39. A safety binding according to claim 34 including means for adjusting the bias exerted by said spring on said force transmission element.

40. A safety binding according to claim 37 wherein said coupling means is constructed and arranged to move the bell crank in said one direction in response to either up-and-down or side-to-side movement of the toe of the boot exceeds a threshold.

41. A safety binding for releasably holding the toe of a skier's boot to the top of a ski having a longitudinally extending median plane, said binding comprising:

a) a base adapted to be attached to the top of the ski;

b) a body mounted on said base for pivotal movement about a first axis perpendicular to said median plane;

c) a pair of retention wings pivotal on said body about spaced axes that are parallel and symmetrically displaced with respect to said median plane, said body being pivotal between an operative position adjacent to the toe of the boot, and in an inoperative position remote from the toe, each of said wings being pivotal between an engaged position in which the wing overlies and engages the toe of the boot when the body is in its operative position, and a released position in which the wing is disengaged from the toe of the boot when the body is in its operative position; and d) actuation means constructed and arranged to effect movement of said body from its operative to its inoperative position in response to downward pivotal movement of the toe of the boot about an axis perpendicular to said median plane.

42. A safety binding according to claim 41 wherein said actuation means includes a force transmission element, a spring for biasing the same, and interconnection means interconnecting said force transmission element with said wings and with said body, said interconnection means being constructed and arranged to displace said force transmission element against the bias of said spring in response to side-to-side pivotal movement of the toe of the boot in a direction perpendicular to said median plane.

43. A safety binding according to claim 41 wherein said actuation means includes a force transmission element, a spring for biasing the same, and interconnection means interconnecting said force transmission element with said wings and with said body, said interconnection means being constructed and arranged to displace said force transmission element against the bias of said spring in response to pivotal movement of said body from its operative position toward its inoperative position.

44. A safety binding according to claim 43 wherein said interconnection means is constructed and arranged to displace said force transmission element against the bias of said spring in response to side-to-side pivotal movement of the toe of the boot.

45. A safety binding according to claim 44 wherein said interconnection means includes a first linkage element pivotal on said base about a second axis parallel to but spaced from said first axis, and coupling means coupling said first linkage element to said force transmission element.

46. A safety binding according to claim 45 wherein said coupling means includes a pin on said force transmission element and a surface on said first linkage element with said pin.

47. A safety binding for releasably holding the toe of a skier's boot to the top of a ski having a longitudinally extending median plane, said binding comprising:

a) a base adapted to be attached to the top of the ski;

b) clamping means mounted on said base for movement between a clamped position at which the toe of the boot is clamped to ski, and an unclamped position at which the toe of the boot is released from the ski;

c) actuation means associated with the clamping means constructed and arranged for moving said clamping means from its clamped position toward its unclamped position in response to downward pivotal movement of the toe of the boot about an axis perpendicular to said median plane, said actuation means including a toe operated pedal mounted on said base for displacement in response to downward pressure of the toe of the boot due to an incipient forward fall of the skier, and linkage means having one end connected to said pedal and the other end connected to said clamping means, said linkage means including a first linkage element movable in response to said displacement of said pedal, and a second linkage element interconnecting said first linkage element with said clamping means for moving the latter toward its unclamped position in response to said movement of said first linkage element;

d) wherein said first linkage element if pivotally mounted on said base and connected to said pedal such that said displacement of said pedal imparts pivotal movement to said first linkage element in one direction, and said second linkage element interconnecting the first linkage element to said clamping means is constructed and arranged to convert pivotal movement of said first linkage element in one direction to movement of said clamping means to said unclamped position; and e) wherein said second linkage element is pivotally connected to said clamping means.

48. A safety binding according to claim 47 wherein said second linkage element is adjustably connected to said clamping means.

49. A safety binding according to claim 47 including a force transmission element mounted for translation, a spring biasing the force transmission element, and interconnection means interconnecting said force transmission element with said first linkage element, said interconnection means being constructed and arranged so that pivotal movement of said first linkage element in said one direction imparts movement to said force transmission element against the bias of said spring.

50. A safety binding according to claim 49 wherein said clamping means includes wings movable on said body between a first position at which the wings overlie the toe of the boot and clamp the same to the ski, and second position at which the wings are free of the boot and release the same from the ski, and means for moving the force transmission element against the bias of said spring in response to movement of the wings from their first to their second positions.

51. A safety binding according to claim 50 wherein said body is pivotally mounted on said base, and wherein said interconnection means is constructed and arranged so that translational movement of the force transmission element in response to movement of the wings causes said linkage means to impart pivotal movement to said body.

52. A safety binding according to claim 50 wherein said body is pivotally mounted on said base, and wherein said interconnection means is constructed and arranged so that translational movement of the force transmission element in a direction against the bias of the spring imparts pivotal movement to said first linkage element.

53. A safety binding according to claim 50 wherein said body is pivotally mounted on said base, and wherein said interconnection means is constructed and arranged so that translational movement of the force transmission element in a direction opposite to the direction of the bias of the spring imparts pivotal movement to said first linkage element.

54. A safety binding according to claim 50 wherein said body is pivotally mounted on said base, and wherein said interconnection means is constructed and arranged to that translational movement of the force transmission element in the same direction as or in a direction opposite to the direction of the bias of the spring imparts pivotal movement to said body.

55. A safety binding for releasably holding the toe of a skier's boot to the top of a ski having a longitudinal median plane, said binding comprising;

a) a base;

b) a body;

c) clamping means pivotally mounted on said body for engaging and maintaining the toe of the boot clamped to the ski when the clamping means is in a clamped position;

d) a pedal pivotal on said base and engageable by the toe of the boot when the latter is clamped to the shoe by the clamping means, and pivotal in response to downward pressure by the toe on the pedal associated with an incipient forward fall of the skier;

e) a first linkage element movable on the base in one direction in response to pivotal movement of said pedal; and f) a second linkage element connecting said first linkage element to said clamping means for effecting pivotal movement to the latter away from its clamped position in response to movement of said first linkage element in said one direction;

g) a movable force transmission element, a spring for biasing said force transmission element in on direction, and interconnection means between the first linkage element and said force transmission element for effecting movement of the latter against the bias of said spring in response to movement of said first linkage element in said one direction whereby downward pressure by the toe on the pedal is resisted by said spring; and h) wherein said body is pivotal on said base about an axis perpendicular to said median plane, and said second linkage element is constructed and arranged so that pivotal movement of the body in response to upward pressure by the toe on said clamping means associated with an incipient rearward fall of the skier imparts movement to said second linkage element which in turn imparts movement to said first linkage element in said one direction whereby pivotal movement of said body in response to upward pressure is resisted by said spring.

* * * * *